US012110638B1

(12) United States Patent
Ren et al.

(10) Patent No.: US 12,110,638 B1
(45) Date of Patent: Oct. 8, 2024

(54) CORONA-RESISTANT N-GRADE INSULATION PAPER FOR VARIABLE FREQUENCY MOTOR AND PREPARATION METHOD THEREOF

(71) Applicant: Sichuan University, Sichuan (CN)

(72) Inventors: Junwen Ren, Sichuan (CN); Qiuwanyu Qing, Sichuan (CN); Shenli Jia, Sichuan (CN); Lihua Zhao, Sichuan (CN); Zi Wang, Sichuan (CN); Fuli Teng, Sichuan (CN); Guoqing Jiang, Sichuan (CN)

(73) Assignee: Sichuan University, Chengdu (CN)

( * ) Notice: Subject to any disclaimer, the term of this patent is extended or adjusted under 35 U.S.C. 154(b) by 0 days.

(21) Appl. No.: 18/424,253

(22) Filed: Jan. 26, 2024

(30) Foreign Application Priority Data

Sep. 11, 2023 (CN) ..... 202311160579.3

(51) Int. Cl.

| | |
|---|---|
| ***D21H 27/38*** | (2006.01) |
| ***D21F 5/18*** | (2006.01) |
| ***D21F 11/00*** | (2006.01) |
| ***D21H 13/26*** | (2006.01) |
| ***D21H 13/38*** | (2006.01) |
| ***D21H 17/68*** | (2006.01) |

(52) U.S. Cl.
CPC ..... *D21H 27/38* (2013.01); *D21F 5/18* (2013.01); *D21F 11/00* (2013.01); *D21H 13/26* (2013.01); *D21H 13/38* (2013.01); *D21H 17/68* (2013.01)

(58) Field of Classification Search
CPC ..... D21H 27/38; D21H 13/38; D21H 13/26; D21H 17/68; D21H 13/44; D21H 27/00; D21F 5/18; D21F 11/00; B32B 2262/0269; B32B 27/12; B82Y 30/00; H01B 3/52
See application file for complete search history.

(56) References Cited

U.S. PATENT DOCUMENTS 10,186,353 B2 * 1/2019 Kang ..... B32B 5/024

FOREIGN PATENT DOCUMENTS

| | | | | | |
|---|---|---|---|---|---|
| CN | 108978328 | A | * | 12/2018 | ..... D21H 13/26 |
| CN | 111945478 | A | | 11/2020 | |
| CN | 115045140 | A | | 9/2022 | |
| CN | 115538215 | A | | 12/2022 | |
| CN | 115584660 | A | | 1/2023 | |
| CN | 116144128 | A | | 5/2023 | |
| CN | 116892129 | A | * | 10/2023 | |
| CN | 116892129 | B | * | 11/2023 | |
| CN | 117285046 | B | * | 1/2024 | |
| EP | 3317091 | B1 | * | 4/2019 | ..... B32B 19/02 |
| WO | WO-2017004187 | A1 | * | 1/2017 | ..... B32B 19/02 |
| WO | WO-2024082973 | A1 | * | 4/2024 | ..... D21H 13/26 |
| WO | WO-2024141111 | A1 | * | 7/2024 | ..... B32B 27/00 |

OTHER PUBLICATIONS

Chen et al., in "Corona Resistance Mechanism of Nano-Modified Polyimide," Polymers, No. 14, 5469, pp. 1-12 (Year: 2022).*

* cited by examiner

*Primary Examiner* — Jose A Fortuna

(57) ABSTRACT

Disclosed are a corona-resistant N-grade insulation paper for a variable frequency motor and a preparation method thereof. The insulation paper has a sandwich structure, aramid nanofibers and mica nanosheets are taken as a sandwich material of the sandwich structure, aramid nanofibers and silicon carbide nanowires being taken as upper and lower surface layer materials, and three layers of materials are electrostatically sprayed and thermo-compressed to prepare the insulation paper. According to the present disclosure, by introducing mica sheets and the silicon carbide nanowires into the aramid nanofibers, the highly ordered arrangement inside the sandwich structure is realized through electrostatic spraying, which improves the temperature resistance and corona resistance of the insulation paper.

10 Claims, 6 Drawing Sheets

CORONA-RESISTANT N-GRADE INSULATION PAPER FOR VARIABLE FREQUENCY MOTOR AND PREPARATION METHOD THEREOF

CROSS-REFERENCE TO RELATED APPLICATIONS

This application claims priority of Chinese Patent Application No. 202311160579.3, filed on Sep. 11, 2023, the entire contents of which are incorporated herein by reference.

TECHNICAL FIELD

The present disclosure relates to the technical field of materials, in particular to a corona-resistant N-grade insulation paper for a variable frequency motor and a preparation method thereof.

BACKGROUND

Variable frequency motors are widely used in new energy vehicles, high-speed railways, machinery manufacturing and other fields, and are an important part of the national economy. As the power supply of variable frequency motor has the characteristics of high frequency, steep rising edge and periodic positive and negative polarity alternation, the variable frequency motor continues to bear the impact of high-frequency voltage, causing serious partial discharge and space charge effect, leading to severe distortion of the internal electric field of variable frequency motor, premature destruction of insulation and serious shortening of life. To prolong the service life of variable frequency motor, it is urgent to develop insulation materials with excellent corona corrosion resistance.

As a common electrical insulation material, an insulation paper has good electrical insulation and high temperature resistance. An aramid insulation paper is widely used in the slot insulation of motors due to its outstanding high temperature resistance, insulation performance and mechanical properties. However, the aramid insulation paper has poor corona resistance, and when the motor works at high frequency and high voltage, the resulting pulse voltage is easy to cause corona corrosion of insulation paper. In addition, the space charge in aramid insulation paper is difficult to dissipate, resulting in the limited corona aging time of insulation paper. At present, researchers have doped mica into the aramid insulation paper to resist corona discharge. However, the improvement of corona resistance of composite insulation paper is very limited due to the low interfacial bonding strength between mica and aramid fiber.

To sum up, in view of the problem that the corona resistance of aramid insulation paper cannot meet the development needs of current motor insulating materials, it is urgent to develop an insulation paper with superior corona resistance.

SUMMARY

An object of the present disclosure is to provide a corona-resistant N-grade insulation paper for a variable frequency motor and a preparation method thereof, to overcome the above drawbacks of the prior art.

A corona-resistant N-grade insulation paper for a variable frequency motor is provided, including a sandwich structure.

Aramid nanofibers and mica nanosheets are taken as a sandwich material of the sandwich structure, aramid nanofibers and silicon carbide nanowires being taken as upper and lower surface layer materials of the sandwich material.

Further, according to the corona-resistant N-grade insulation paper for a variable frequency motor as described above, the aramid nanofiber has a diameter of 10-50 nm and a length of more than 3 μm, the mica nanosheet has a particle size of 2-10 μm and a thickness of less than 10 nm, and the silicon carbide nanowire has a diameter of 80-500 nm and a length of greater than 5 μm, the aramid nanofibers being para-aramid nanofibers, and the mica nanosheets being synthetic mica nanosheets.

Further, according to the corona-resistant N-grade insulation paper for a variable frequency motor as described above, a mass ratio of the aramid nanofibers to the mica nanosheets is (9-5):(1-5).

Further, according to the corona-resistant N-grade insulation paper for a variable frequency motor as described above, a mass ratio of the aramid nanofibers to the silicon carbide nanowires is 9:1.

A preparation method for a corona-resistant N-grade insulation paper for a variable frequency motor as described above includes the steps of:

1) taking aramid nanofibers and silicon carbide nanowires as raw materials to prepare a surface layer composite slurry;
2) taking aramid nanofibers and mica nanosheets as raw materials to prepare a sandwich composite slurry;
3) spraying the surface layer composite slurry on a substrate through electrostatic spraying to form a lower surface layer gel;
4) spraying the sandwich composite slurry on an upper surface of the lower surface layer gel through electrostatic spraying to form a sandwich gel;
5) spraying the surface layer composite slurry on an upper surface of the sandwich gel again through electrostatic spraying to form an upper surface layer gel;
6) drying the prepared three-layer gel under vacuum at 50-73° C. for 36-48 h to obtain a sandwich insulation rough paper; and
7) performing thermo-compression formation on the insulation rough paper at 20 Mpa at 175-195° C. to obtain the corona-resistant N-grade insulation paper for a variable frequency motor having a sandwich structure.

Further, in the preparation method as described above, both the lower surface layer gel and the upper surface layer gel have a thickness of 200 μm-500 μm; and the sandwich gel has a thickness of 500 μm-1000 μm.

Further, in the preparation method as described above, the preparation of the surface layer composite slurry includes the steps of:

adding the aramid nanofibers and the silicon carbide nanowires into 400 ml of deionized water in a mass ratio of 9:1, and uniformly mixing and pulping the same by high-speed shearing at 10000-15000 rpm for 15 min to obtain the surface layer composite slurry.

Further, in the preparation method as described above, the preparation of the sandwich composite slurry includes the steps of:

adding the aramid nanofibers and the mica nanosheets into 400 mL of deionized water in a mass ratio of (9-5):(1-5), and uniformly mixing and pulping the same by high-speed shearing at 10000-25000 rpm for 15 min to obtain the sandwich composite slurry.

Further, in the preparation method as described above, the preparation of the aramid nanofibers includes the steps of:

placing aramid fibres, after being cleaned by acetone and dried, in a low-temperature plasma treatment instrument with a power of 200 W and a vacuum degree of 100 Pa to be treated for 6 min by introducing argon gas with a flow rate of 30 mL/min; and placing the plasma-treated aramid fibers with potassium hydroxide and dimethyl sulfoxide in a ratio of 1 g: 1.5 g: 500 ml in a sealed container, and stirring mechanically at a rotation speed of 1000 rpm at room temperature for 7 d continuously to obtain aramid nanofibers stably dispersed in a potassium hydroxide/dimethyl sulfoxide system.

Further, in the preparation method as described above, the preparation of the mica nanosheets includes the steps of:

adding synthetic mica and hexadecyl trimethyl ammonium bromide into deionized water to obtain a mica dispersion liquid, a ratio of the synthetic mica, hexadecyl trimethyl ammonium bromide and the deionized water being 10 g: 10 g: 500 ml;

stirring the dispersion liquid in a water bath at 80° C. for 2 h to fully dissolve hexadecyl trimethyl ammonium bromide;

sonicating the fully dissolved dispersion liquid in the water bath for 6 h, and stripping mica through the ultrasonic cavitation effect and the intercalation assistance of hexadecyl trimethyl ammonium bromide to obtain the mica nanosheets, an ultrasonic power being 300-350 W;

centrifuging the sonicated mica nanosheet dispersion solution and repeatedly washing the same with deionized water to remove residual hexadecyl trimethyl ammonium bromide on surfaces of the mica nanosheets, a centrifugation speed being 4500-5000 rpm; and drying the obtained solid under vacuum at 80° C. for 12 h to obtain the synthetic mica nanosheets.

The present disclosure has the following advantageous effects. According to the corona-resistant N-grade insulation paper for a variable frequency motor provided by the present disclosure, the aramid nanofibers are taken as a skeleton network, the mica nanosheets as corona-resistant functional elements, the silicon carbide nanowires as charge dissipation functional elements, the aramid nanofibers and the mica nanosheets as sandwich materials, and the aramid nanofibers and the silicon carbide nanowires as upper and lower surface layer materials of the sandwich materials. The composite insulation paper having the sandwich structure is constructed through ordered assembly of microstructures, a surface charge rapid dissipation channel is constructed, a micro-ordered imitation "brick-and-mortar structure" is constructed in the sandwich, and a dense barrier to inhibit bulk charge transport is formed, thus regulating charge transport in the insulation paper and ultimately improving the corona resistance of the insulation paper.

According to the method provided by the present disclosure, the ordered microstructure is reliably constructed in the composite insulation paper layer by adopting the electrostatic spraying process. A highly efficient and robust charge dissipation path is formed by the directional arrangement of silicon carbide nanowires on the surface layer structure. A dense and orderly topological barrier of aramid nanofibers/mica nanosheets is constructed in the sandwich structure, thus effectively inhibiting the bulk charge transport and the growth of electrical branches, further regulating the charge transport in the insulation paper, and greatly improving the corona resistance of composite insulation paper.

According to the method provided by the present disclosure, the mica nanosheets are introduced into an aramid nanofiber matrix by means of high-speed shear blending to construct an ordered imitation "brick-and-mortar structure", and at the same time, by introducing the silicon carbide nanowires with typical non-linear characteristics, the surface charge dissipation is rapidly realized, thus imparting excellent electric field regulation capability to the composite insulation paper. The sandwich structure of corona-resistant composite insulation paper is prepared by the electrostatic spraying process to achieve the level assembly between slurries.

The aramid nanofiber provided by the present disclosure is a para-aramid nanofiber. After the para-aramid fiber is treated with plasma, a certain number of polar functional groups carbonyl and carboxyl are introduced on the surface of the para-aramid fiber, and the change of the surface chemical composition of the fiber provides more active sites, thus overcoming the chemical inertness. However, the etching effect of plasma increases the surface roughness of the fiber, thus increasing the surface area and gripping force, improving the adhesion properties, and providing a basis for flexible design of functional aramid insulation paper.

According to the method provided by the present disclosure, the mica nanosheets are used as corona-resistant building elements, and since the mica nanosheets have abundant hydroxyl groups on the surface, the abundant hydroxyl groups are mixed with aramid nanofibers to form an ordered and dense structure, which can not only greatly improve the corona resistance of the composite, but also can impart excellent mechanical strength and breakdown strength to the composite.

According to the method provided by the present disclosure, the silicon carbide nanowires are used as charge dissipation functional elements, which can impart excellent electric field regulation capability to a composite insulation paper due to its typical non-linear characteristics. Therefore, taking the silicon carbide nanowires as the charge dissipation functional elements, through high-speed shearing and electrostatic spraying processes, a fast charge dissipation channel can be constructed on the surface of insulation paper, thus improving the corona resistance of composite insulation paper.

According to the corona-resistant N-grade insulation paper for a variable frequency motor provided by the present disclosure, when the mass ratio of aramid nanofibers to mica nanosheets is low, since aramid nanofibers are the main component, the excellent mechanical properties of the insulation paper can be better played, and a sufficient fiber content is beneficial to the better coating of mica sheets. Therefore, the mass ratio of aramid nanofibers to mica nanosheets is selected to be (9-5):(1-5).

According to the corona-resistant N-grade insulation paper for a variable frequency motor provided by the present disclosure, the molecular scale mixing between aramid nanofibers and silicon carbide nanowires can be effectively ensured by controlling the mass ratio of aramid nanofibers to silicon carbide nanowires to be 9:1 because the silicon carbide nanowires are easy to aggregate and difficult to disperse.

According to the method provided by the present disclosure, the highly ordered arrangement of mica nanosheets and silicon carbide nanowires are facilitated by the electrostatic spraying process, thus forming an efficient and robust charge rapid dissipation path in the composite insulation paper having the sandwich structure, and improving the corona resistance characteristics of composite insulation paper.

In summary, the present disclosure has the following advantages.

1. Compared with the existing composite insulation paper, the corona-resistant N-grade insulation paper provided by the present disclosure has significantly improved corona-resistant characteristics and good mechanical strength and breakdown strength.

2. In the present disclosure, the method for preparing the composite insulation paper has the advantages of simplicity, easy operation, low cost and high quality, which is suitable for industrial mass production.

DETAILED DESCRIPTION

Figure 1:
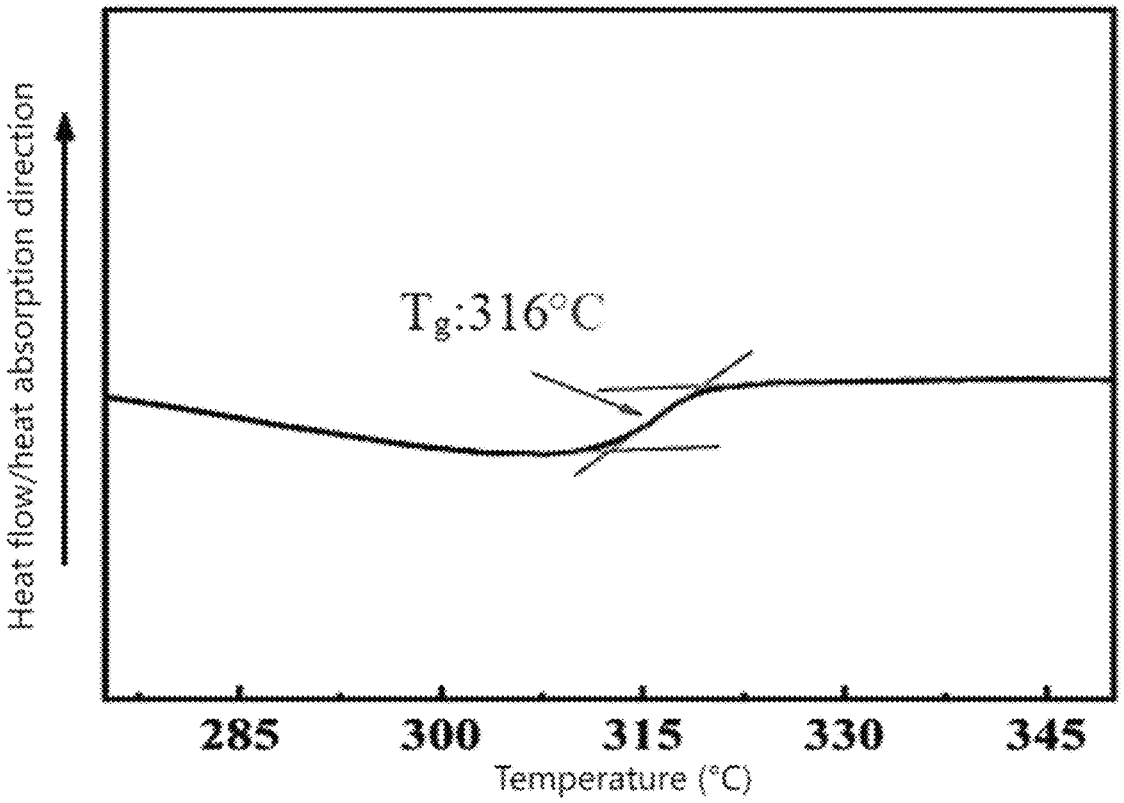
FIG. 1 is a differential scanning calorimetry (DSC) diagram of an N-grade insulation paper prepared in an example.
Figure 2:
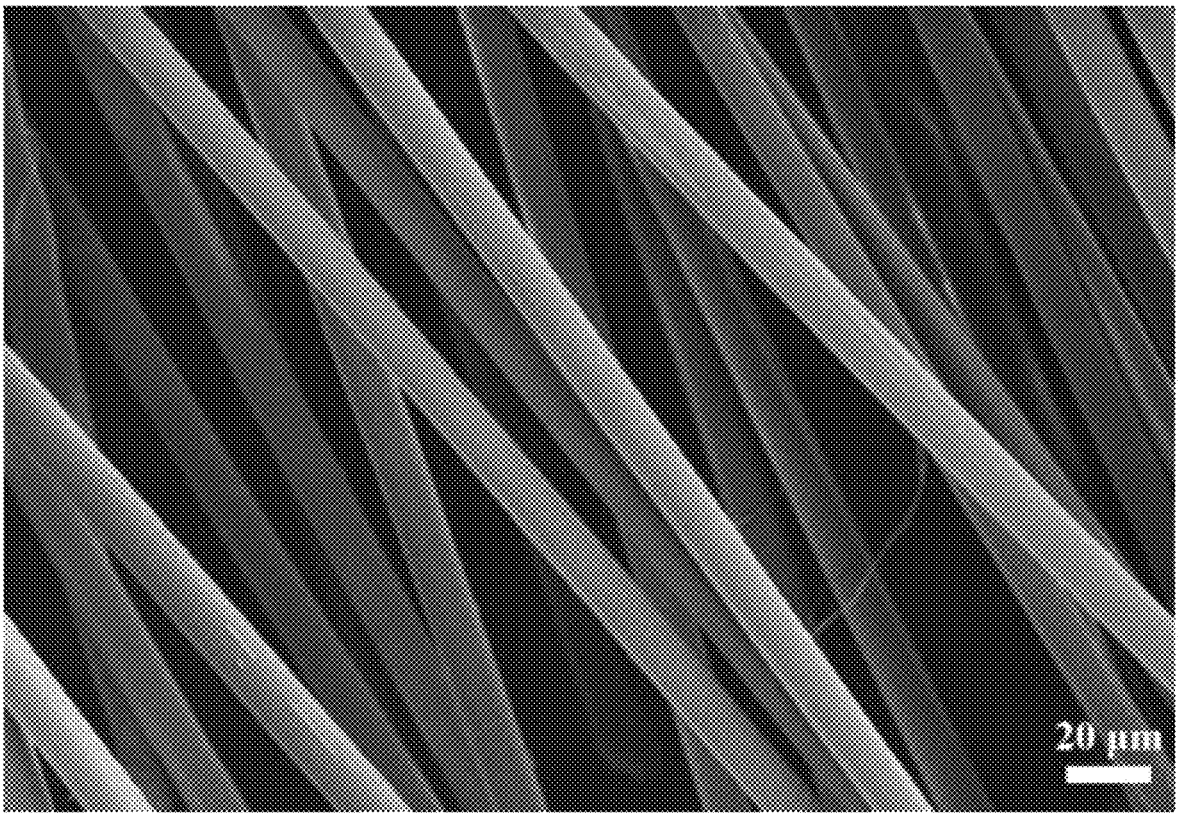
FIG. 2 is a scanning electron microscope diagram of a para-aramid fiber.
Figure 3:
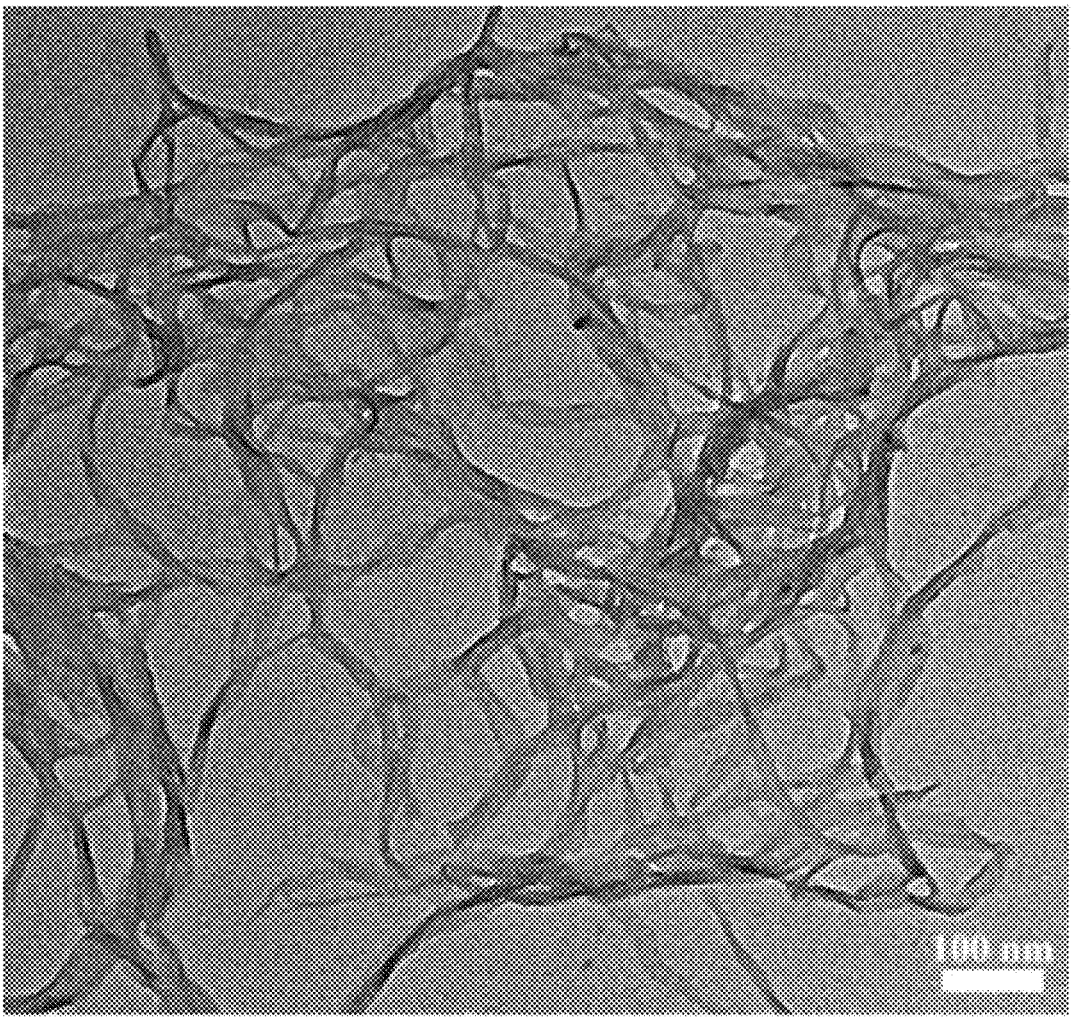
FIG. 3 is a transmission electron microscope diagram of an aramid nanofiber.
Figure 4:
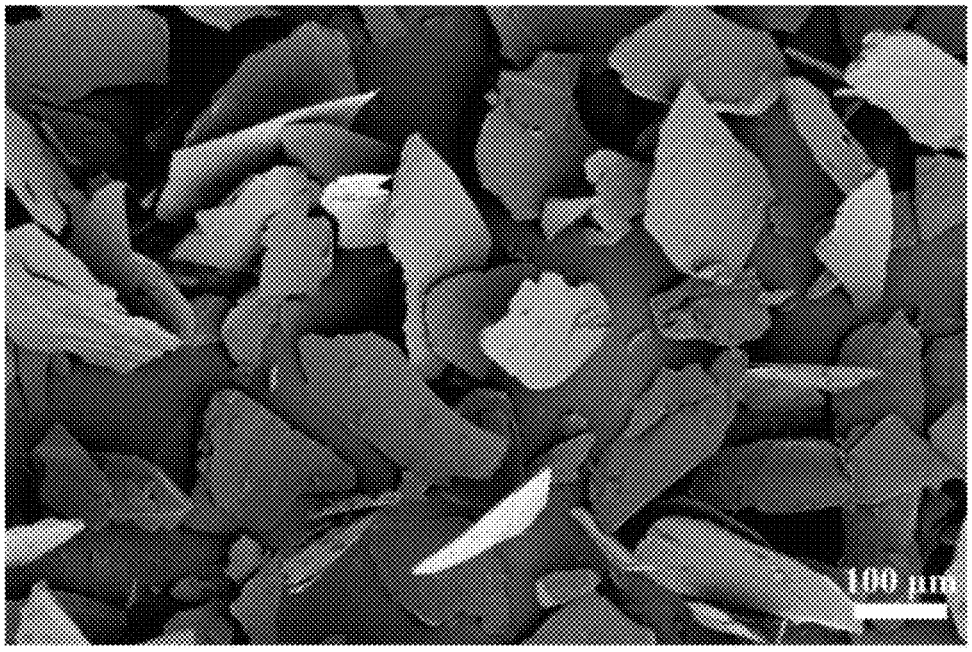
FIG. 4 is a scanning electron microscope diagram of a synthetic mica.
Figure 5:
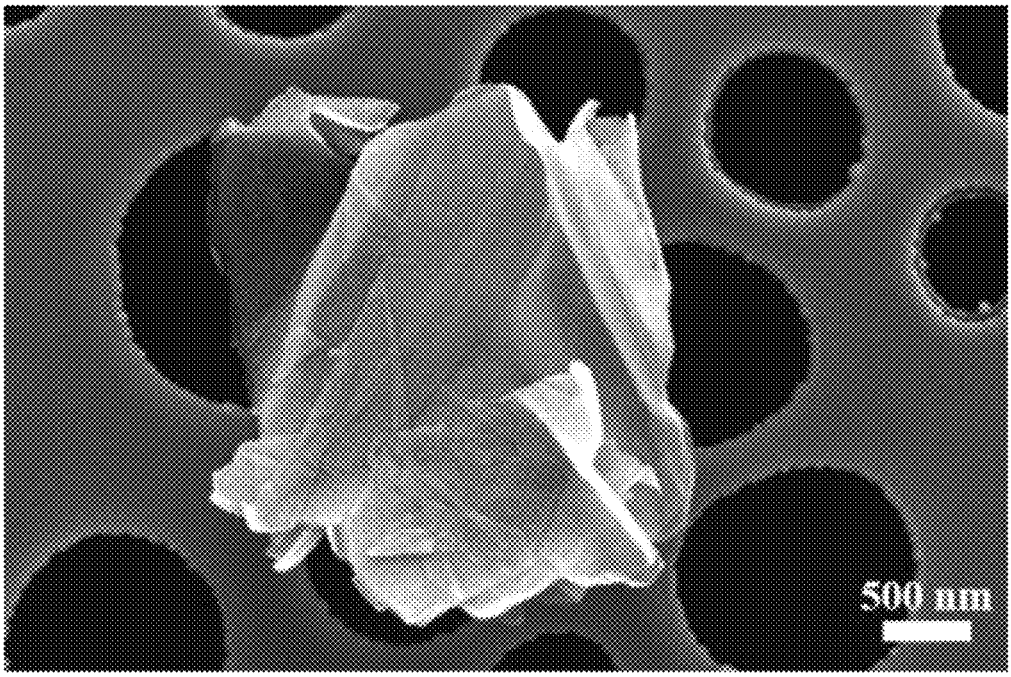
FIG. 5 is a transmission electron microscope diagram of a mica nanosheet.
Figure 6:
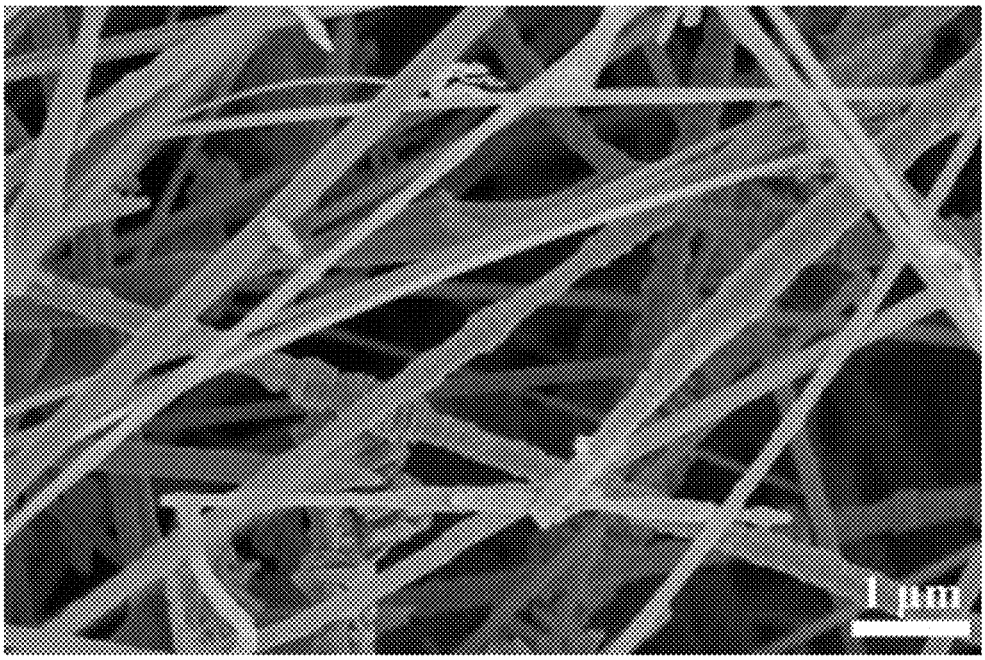
FIG. 6 is a transmission electron microscope diagram of silicon carbide nanowires.
Figure 7:
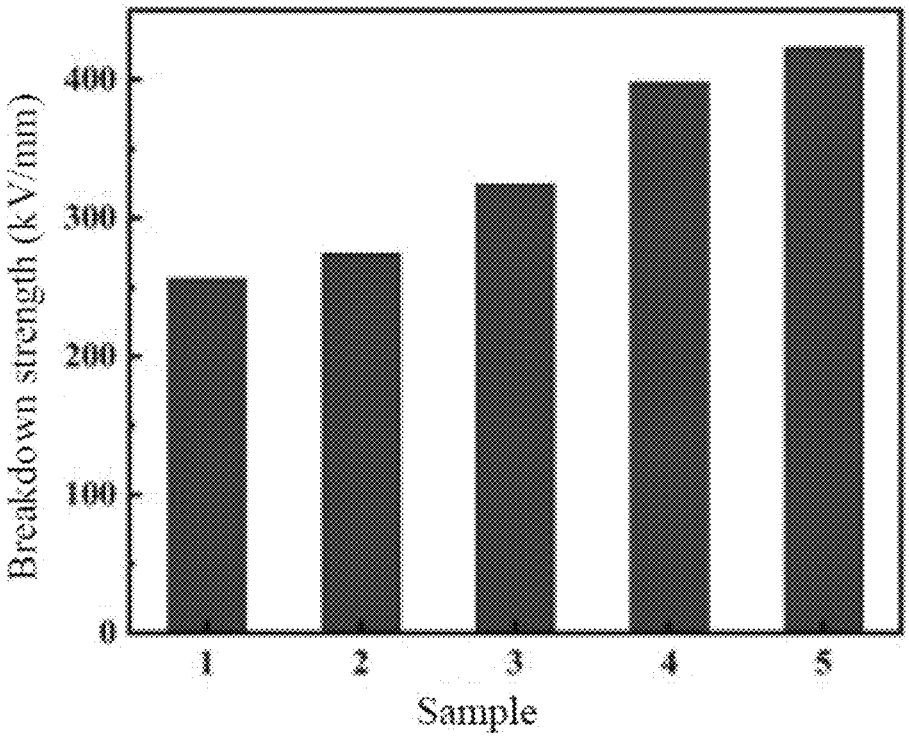
FIG. 7 is a comparison diagram of breakdown strengths of composite insulation papers in Examples 1-5.
Figure 8:
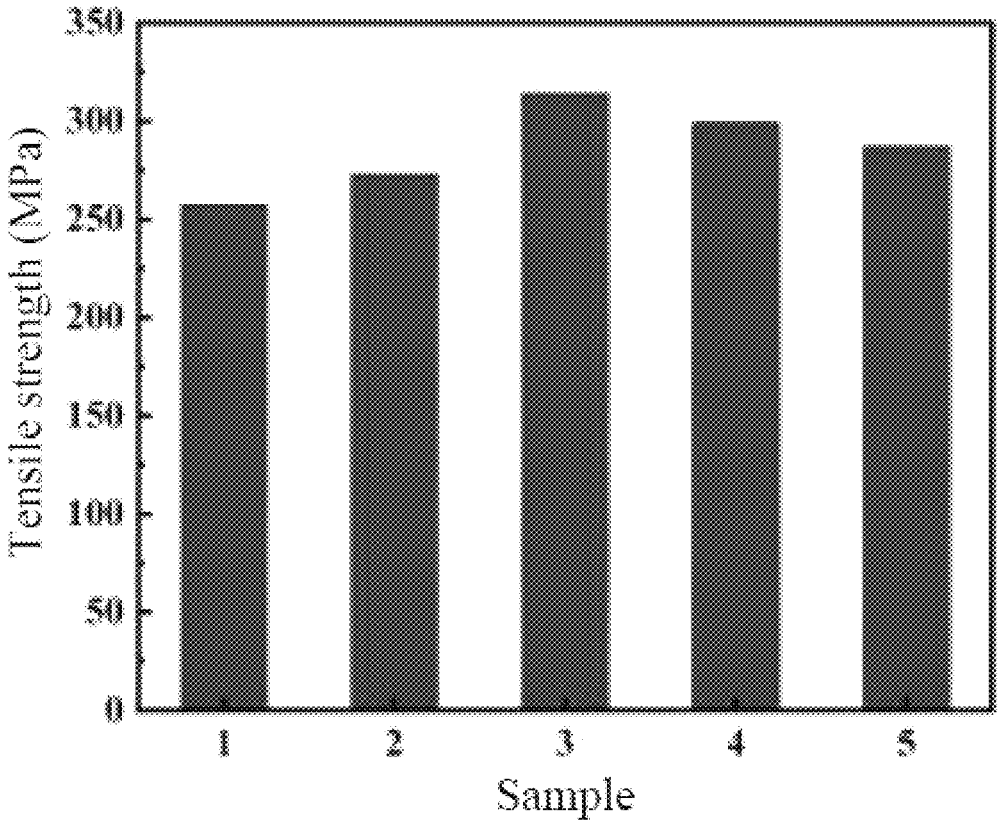
FIG. 8 is a comparison diagram of tensile strengths of composite insulation papers in Examples 1-5.

In order to make the object, technical solutions and advantages of the present disclosure clearer, the technical solutions in the present disclosure are described clearly and completely below. Obviously, all the described examples are only some, rather than all examples of the present disclosure. Based on the examples in the present disclosure, all other examples obtained by those of ordinary skill in the art without creative efforts belong to the scope of protection of the present disclosure.

The N-grade insulation paper provided by the present disclosure is an insulation paper having a heat resistance temperature higher than 220° C. The N-grade insulation paper provided by the present disclosure is a sandwich structure. The sandwich structure takes aramid nanofibers and mica nanosheets as the sandwich material, and aramid nanofibers and silicon carbide nanowires as upper and lower surface layer materials of the insulation paper; then the three-layer material is sprayed and hot-pressed to prepare a corona-resistant N-grade insulation paper with higher temperature resistance and corona resistance. The preparation processes of the corona-resistant N-grade insulation paper are as follows. Firstly, the blended surface layer slurry of aramid nanofibers/silicon carbide nanowires is electrostatically sprayed on a substrate to obtain a lower surface layer gel; further, the compounded sandwich slurry of aramid nanofibers/mica nanosheets is sprayed on the lower surface layer gel to obtain a sandwich gel; and finally, the surface layer slurry of aramid nanofibers/silicon carbide nanowires is sprayed on the sandwich gel again to obtain an upper surface layer gel. The obtained three-layer gel is subsequently vacuum-dried and then hot-pressed at a high temperature to obtain the corona-resistant N-grade insulation paper.

Example 1: the example provided a corona-resistant N-grade insulation paper for a variable frequency motor. The N-grade insulation paper took aramid nanofibers as a skeleton network, mica nanosheets as corona-resistant functional elements, and silicon carbide nanowires as charge dissipation functional elements. The sandwich structure took the aramid nanofibers and mica nanosheets as a sandwich material of the insulation paper, aramid nanofibers and silicon carbide nanowires as upper and lower surface layer materials of the insulation paper. In the example, the aramid nanofiber was a para-aramid nanofiber having a diameter of 10-50 nm and a length of more than 3 μm; the mica nanosheet, obtained by striping synthetic mica, had a particle size of 2-10 μm and a thickness of less than 10 nm; and the silicon carbide nanowire had a diameter of 80-500 nm and a length of greater than 5 μm.

A preparation method for a corona-resistant N-grade insulation paper for a variable frequency motor as described above included the following steps.

At 1): para-aramid fibers were taken as raw materials, and preprocessed by plasma and stripped with a concentrated alkali solution to prepare aramid nanofibers:

para-aramid fibres, after being cleaned by acetone and dried, were placed in a low-temperature plasma treatment instrument with a power of 200 W and a vacuum degree of 100 Pa to be treated for 6 min by introducing oxygen gas with a flow rate of 30 mL/min; and the plasma-treated para-aramid fibers with potassium hydroxide and dimethyl sulfoxide in a ratio of 1 g: 1.5 g: 500 mL were placed in a sealed container, and mechanically stirred at a rotation speed of 1000 rpm at room temperature for 7 d continuously to obtain aramid nanofibers stably dispersed in a potassium hydroxide/dimethyl sulfoxide system.

At 2): mica nanosheets were prepared by liquid-phase ultrasonic stripping by taking synthetic mica as a raw material:

synthetic mica and hexadecyl trimethyl ammonium bromide were added into deionized water to obtain a mica dispersion liquid, a ratio of the synthetic mica, hexadecyl trimethyl ammonium bromide and the deionized water being 10 g: 10 g: 500 ml; the dispersion liquid was stirred in a water bath at 80° C. for 2 h to fully dissolve hexadecyl trimethyl ammonium bromide; the obtained dispersion liquid was sonicated in the water bath for 6 h, and mica was stripped through the ultrasonic cavitation effect and the intercalation assistance of hexadecyl trimethyl ammonium bromide to obtain the mica nanosheets, an ultrasonic power being 350 W; the obtained mica nanosheet dispersion solution after sonication was centrifuged at a high speed and repeatedly washed with deionized water to remove residual hexadecyl trimethyl ammonium bromide on surfaces of the mica nanosheets, a centrifugation speed being 5000 rpm; and the obtained solid was vacuum-dried at 80° C. for 12 h to obtain the synthetic mica nanosheets.

At 3): the aramid nanofibers and the synthetic mica nanosheets were added into 400 ml of deionized water in a mass ratio of 9:1, and uniformly mixed and pulped by high-speed shearing at 10000 rpm for 15 min to obtain a sandwich composite slurry.

At 4): the aramid nanofibers and the silicon carbide nanowires were added into 400 mL of deionized water in a mass ratio of 9:1, and uniformly mixed and pulped by high-speed shearing at 15000 rpm for 15 min to obtain upper and lower surface layer composite slurries.

At 5): the lower surface layer composite slurry was electrostatically sprayed on a substrate to prepare a lower surface layer gel with a thickness of 200 μm:

the lower surface layer composite slurry was transferred to a spray gun, ensuring that the spray gun was firmly connected to the spraying equipment, the spraying equipment was reliably connected to the substrate, and a surface of the substrate was sprayed by the spray gun at an appropriate distance and angle to form the lower surface layer gel.

At 6): the sandwich composite slurry was electrostatically sprayed on a surface of a bottom layer gel to prepare a sandwich gel with a thickness of 500 μm:

the sandwich composite slurry was transferred to the spray gun, ensuring that the spray gun was firmly connected to the spraying equipment, the spraying equipment was reliably connected to the substrate, and a surface of the lower surface layer gel was sprayed by the spray gun at an appropriate distance and angle to form the sandwich gel.

At 7): an upper surface layer composite slurry was electrostatically sprayed on a surface of the sandwich gel to form an upper surface layer gel with a thickness of 500 μm:

the upper surface layer composite slurry was transferred to the spray gun, ensuring that the spray gun was firmly connected to the spraying equipment, the spraying equipment was reliably connected to the substrate, and a surface of the sandwich gel was sprayed by the spray gun at an appropriate distance and angle to form the upper surface layer gel. At this point, a three-layer gel including lower surface layer gel, sandwich gel and upper surface layer gel was obtained.

At 8): the prepared three-layer gel sample was vacuum-dried at 50-73° C. for 36-48 h to obtain a sandwich insulation rough paper.

At 9): thermo-compression formation was performed on the obtained sandwich insulation rough paper through a vacuum hot press at 20 Mpa at 175-195° C. to obtain the corona-resistant insulation paper having the sandwich structure.

Experimental Example: a glass transition temperature (Tg) of the composite insulation paper prepared in Example 1 was analyzed by DSC. As shown in FIG. 1, it could be seen from the DSC temperature rise curve in FIG. 1 that the Tg of the composite insulation paper was as high as 316° C., and the composite insulation paper had excellent heat resistance and met the requirements of N-grade insulation paper.

Example 2: the example differs from Example 1 in that: a mass ratio of the aramid nanofibers to the mica nanosheets was 8:2.

Example 3: the example differs from Example 1 in that: a mass ratio of the aramid nanofibers to the mica nanosheets was 7:3.

Example 4: the example differs from Example 1 in that: a mass ratio of the aramid nanofibers to the mica nanosheets was 6:4.

Example 5: the example differs from Example 1 in that: a mass ratio of the aramid nanofibers to the mica nanosheets was 5:5.

Example 6: the example differs from Example 1 in that: in step 2), an ultrasonic power was 300 W and a high-speed centrifugation speed was 4500 rpm; in step 3), a rate of high-speed shearing was 15000 rpm; and in step 4), a rate of high-speed shearing was 10000 rpm.

Example 7: the example differs from Example 1 in that: a thickness of the lower surface layer gel was 500 μm; a thickness of the sandwich gel was 1000 μm; and a thickness of the upper surface layer gel was 200 μm.

Comparative Example 1: aramid-mica composite slurry was obtained by mixing aramid nanofibers with synthetic mica through high-speed shearing. An aramid-mica rough paper was obtained through electrostatic spraying, and the aramid-mica insulation paper was obtained through high-temperature hot pressing.

Comparative Example 2: the example differs from Example 1 in that: the sandwich gel is composed of only aramid nanofibers.

Comparative Example 3: the example differs from Example 1 in that: the upper and lower surface layer gels are composed of only aramid nanofibers. The composite insulation paper obtained in each example of the present disclosure and the composite insulation paper obtained in each comparative example were examined by using a high-frequency pulse voltage tester.

Through comparison, it was found that the preparation method provided by the present disclosure could significantly improve the corona-resistant time of the corona-resistant N-grade insulation paper. With the increase of the content of mica nanosheets, the corona-resistant time of corona-resistant N-grade insulation paper increases. Compared with the conventional aramid-mica insulation paper prepared by compounding aramid nanofibers with synthetic mica in the comparative example, it was obvious that the corona-resistant N-grade insulation paper prepared by the method of the present disclosure has a significant improvement in the corona-resistant time due to the excellent insulation performance of the corona-resistant N-grade insulation paper prepared by the present disclosure, effectively preventing the current from flowing in the paper and reducing the occurrence of corona. In addition, the corona-resistant N-grade insulation paper prepared by the present disclosure has high mechanical strength and can bear certain tensile resistance, protecting the paper from being damaged by external forces, and delaying the generation and propagation of corona.

Through comparison, it could be seen that for the same example, a corona aging time of a film at a pulse amplitude of 2 kV was greater than that at a pulse amplitude of 3 kV, because the greater the pulse amplitude, the higher the intensity of the pulse voltage and the higher the energy of the charged particles generated, the more easily the material was damaged.

According to FIGS. 2-8, it can be concluded that:

1. The composite insulation paper prepared by the present disclosure has excellent mechanical strength (tensile strength>250 MPa) and ultra-high breakdown strength (breakdown strength>300 kV/mm). The mass ratio of aramid nanofibers to mica nanosheets is controlled at (9-5):(1-5), to cause the tensile strength of the prepared composite insulation paper to increase gradually with the increase of the mass ratio of aramid nanofibers to mica nanosheets, and to cause the breakdown strength to decrease gradually with the increase of the mass ratio of aramid nanofibers to mica nanosheets.

2. When the mass ratio of aramid nanofibers to mica nanosheets is larger, the breakdown strength of composite insulation paper is lower, which is because when the content of mica nanosheets is lower, the blocking effect on current is weakened and the current passage is increased.

3. When the content of mica nanosheets is too high, the aramid nanofibers cannot play a good role in coating and bonding and cannot exert its own superior mechanical properties, and the tensile strength of composite insulation paper is low.

Finally, it is to be noted that: the above examples are only used to illustrate the technical solutions of the present disclosure, but not limited thereto. Although the present disclosure has been described in detail with reference to the foregoing examples, it is to be understood by those of ordinary skill in the art that the technical solutions described in the foregoing examples can still be modified, or some technical features can be replaced by equivalents; while these modifications or replacements do not make the essence of the corresponding technical solutions deviate from the spirit and scope of the technical solutions of various examples of the present disclosure.

The invention claimed is:

1. A corona-resistant N-grade insulation paper for a variable frequency motor, comprising a sandwich structure, wherein aramid nanofibers and mica nanosheets are taken as a sandwich material of the sandwich structure, aramid nanofibers and silicon carbide nanowires being taken as upper and lower surface layer materials of the sandwich material.

2. The corona-resistant N-grade insulation paper for a variable frequency motor according to claim 1, wherein the aramid nanofiber has a diameter of 10-50 nm and a length of more than 3 μm, the mica nanosheet has a particle size of 2-10 μm and a thickness of less than 10 nm, and the silicon carbide nanowire has a diameter of 80-500 nm and a length of greater than 5 μm, the aramid nanofibers being para-aramid nanofibers, and the mica nanosheets being synthetic mica nanosheets.

3. The corona-resistant N-grade insulation paper for a variable frequency motor according to claim 1, wherein a mass ratio of the aramid nanofibers to the mica nanosheets is (9-5):(1-5).

4. The corona-resistant N-grade insulation paper for a variable frequency motor according to claim 1, wherein a mass ratio of the aramid nanofibers to the silicon carbide nanowires is 9:1.

5. A preparation method for a corona-resistant N-grade insulation paper for a variable frequency motor according to claim 1, comprising the steps of:

1) Taking aramid nanofibers and silicon carbide nanowires as raw materials to prepare a surface layer composite slurry;
2) Taking aramid nanofibers and synthetic mica nanosheets as raw materials to prepare a sandwich composite slurry;
3) Spraying the surface layer composite slurry on a substrate through electrostatic spraying to form a lower surface layer gel;
4) Spraying the sandwich composite slurry on an upper surface of the lower surface layer gel through electrostatic spraying to form a sandwich gel;
5) Spraying the surface layer composite slurry on an upper surface of the sandwich gel again through electrostatic spraying to form an upper surface layer gel;
6) Drying the prepared three-layer gel under vacuum at 50-73° C. for 36-48 h to obtain a sandwich insulation rough paper; and
7) Performing thermo-compression formation on the sandwich insulation rough paper at 20 Mpa at 175-195° C. to obtain the corona-resistant N-grade insulation paper for a variable frequency motor having a sandwich structure.

6. The preparation method according to claim 5, wherein both the lower surface layer gel and the upper surface layer gel have a thickness of 200 μm-500 μm; and the sandwich gel has a thickness of 500 μm-1000 μm.

7. The preparation method according to claim 5, wherein the preparation of the surface layer composite slurry comprises the steps of:

adding the aramid nanofibers and the silicon carbide nanowires into 400 mL of deionized water in a mass ratio of 9:1, and uniformly mixing and pulping the same by high-speed shearing at 10000-15000 rpm for 15 min to obtain the surface layer composite slurry.

8. The preparation method according to claim 5, wherein the preparation of the sandwich composite slurry comprises the steps of:

adding the aramid nanofibers and the mica nanosheets into 400 mL of deionized water in a mass ratio of (9-5):(1-5), and uniformly mixing and pulping the same by high-speed shearing at 10000-25000 rpm for 15 min to obtain the sandwich composite slurry.

9. The preparation method according to claim 5, wherein the preparation of the aramid nanofibers comprises the steps of:

placing aramid fibres, after being cleaned by acetone and dried, in a low-temperature plasma treatment instrument with a power of 200 W and a vacuum degree of 100 Pa to be treated for 6 min by introducing argon gas with a flow rate of 30 mL/min; and placing the plasma-treated aramid fibers with potassium hydroxide and dimethyl sulfoxide in a ratio of 1 g: 1.5 g: 500 mL in a sealed container, and stirring mechanically at a rotation speed of 1000 rpm at room temperature for 7 d continuously to obtain aramid nanofibers stably dispersed in a potassium hydroxide/dimethyl sulfoxide system.

10. The preparation method according to claim 5, wherein the preparation of the mica nanosheets comprises the steps of:

adding synthetic mica and hexadecyl trimethyl ammonium bromide into deionized water to obtain a mica dispersion liquid, a ratio of the synthetic mica, hexadecyl trimethyl ammonium bromide and the deionized water being 10 g: 10 g: 500 ml;

stirring the mica dispersion liquid in a water bath at 80° C. for 2 h to fully dissolve hexadecyl trimethyl ammonium bromide;

sonicating the fully dissolved mica dispersion liquid in the water bath for 6 h, and stripping mica through the ultrasonic cavitation effect and the intercalation assistance of hexadecyl trimethyl ammonium bromide to obtain the mica nanosheets, an ultrasonic power being 300-350 W;

centrifuging the sonicated mica nanosheet dispersion solution and repeatedly washing the same with deionized water to remove residual hexadecyl trimethyl ammonium bromide on surfaces of the mica nanosheets, a centrifugation speed being 4500-5000 rpm; and drying the obtained solid under vacuum at 80° C. for 12 h to obtain the synthetic mica nanosheets.

* * * * *